US006206011B1

(12) United States Patent
Sartena

(10) Patent No.: US 6,206,011 B1
(45) Date of Patent: Mar. 27, 2001

(54) HAIR ACCESSORY

(75) Inventor: Stacey Eve Sartena, Great Neck, NY (US)

(73) Assignee: Hair Blast, Inc., Great Neck, NY (US)

( * ) Notice: Subject to any disclaimer, the term of this patent is extended or adjusted under 35 U.S.C. 154(b) by 0 days.

(21) Appl. No.: 09/441,227

(22) Filed: Nov. 15, 1999

Related U.S. Application Data

(63) Continuation-in-part of application No. 29/098,789, filed on Jan. 6, 1999.

(51) Int. Cl.[7] ..... A45D 8/12; A41G 3/00
(52) U.S. Cl. ..... 132/275; 132/201; 132/53
(58) Field of Search ..... 132/275, 201, 132/53, 54, 55, 277, 276; 2/171, 207

(56) References Cited

U.S. PATENT DOCUMENTS

| | | | |
|---|---|---|---|
| 250,967 | | 12/1881 | Presser . |
| D. 261,181 | | 10/1981 | Sands . |
| D. 335,390 | | 5/1993 | Yim . |
| D. 356,398 | | 3/1995 | Hafid . |
| D. 381,119 | | 7/1997 | Chang . |
| D. 381,767 | | 7/1997 | Chang . |
| D. 384,786 | | 10/1997 | LaFauci . |
| 794,479 | | 7/1905 | Austin . |
| 1,346,718 | | 7/1920 | Muller . |
| 1,526,440 | | 2/1925 | Skaruda . |
| 1,594,741 | | 8/1926 | Lewis . |
| 1,714,358 | | 5/1929 | Finkelstein . |
| 2,620,809 | | 12/1952 | Rosen . |
| 2,651,310 | | 9/1953 | Selson . |
| 2,849,007 | | 8/1958 | Behr . |
| 4,254,783 | | 3/1981 | Kim . |
| 4,998,186 | | 3/1991 | Cocca . |
| 5,441,061 | | 8/1995 | Jordan et al. ..... 132/275 |
| 5,501,239 | * | 3/1996 | Walker ..... 132/275 |
| 5,549,127 | | 8/1996 | Chang ..... 132/277 |
| 5,803,096 | | 9/1998 | Lee ..... 132/277 |
| 5,873,377 | | 2/1999 | Yang ..... 132/276 |
| 5,890,498 | | 4/1999 | Kawaguchi ..... 132/275 |
| 6,019,107 | * | 2/2000 | Overmyer et al. ..... 132/53 |

FOREIGN PATENT DOCUMENTS

| | | |
|---|---|---|
| 126305 | 6/1928 | (CH) . |
| 135892 | 12/1929 | (CH) . |
| 6823 | 7/1904 | (DK) . |
| 421964 | 3/1911 | (FR) . |
| 460804 | 12/1913 | (FR) . |
| 540368 | 7/1922 | (FR) . |
| 23134 | 10/1897 | (GB) . |

* cited by examiner

*Primary Examiner*—Gene Mancene
*Assistant Examiner*—Robyn Kieu Doan
(74) *Attorney, Agent, or Firm*—Schweitzer Cornman Gross & Bondell LLP

(57) ABSTRACT

A hair accessory formed of a claw-type hair clip and a ribbon=like strip of natural or synthetic cut hair. The clip has two movable parts, each having comb-like tines with spaces therebetween. In the closed condition of the clip, the tines of one part are received in spaces of the other. One end margin of the ribbon-like strip of cut hair is fixed to an inside surface of one of the clip parts, and individual groups of hair strands of the ribbon-like strip are lead through a plurality of between-tines spaces of the same clip part. The groups may be braided individually or combined on the outside of the clip to form a fewer number of braids than groups. Beads or other eye-catching embellishments may be attached to the braids for enhanced fashion effects. The individual hair groups may also be draped loosely from the clip. By securing the cut hair on the inside of the clip part and leading the hair out between the tines, the cut hair has the appearance of natural hair of the user.

9 Claims, 10 Drawing Sheets

HAIR ACCESSORY

RELATED APPLICATIONS

This application is a continuation-in-part of my co-pending U.S. application Ser. No. 29/098,789, filed Jan. 6, 1999.

BACKGROUND AND SUMMARY OF THE INVENTION

The present invention is directed to hair accessories, and more particularly to a novel and improved hair accessory device providing a novel and advantageous means of incorporating supplemental, decorative hair elements into the natural hair of the user.

Various devices are known in the art for attaching hair supplements, either in the form of natural hair, or synthetic hair into the natural hair arrangement of the user. Typically, such hair supplements may comprise decorative braids, or in some cases unbraided strands. All of the known devices of which I am aware have significant disadvantages. In some cases, the devices are insecurely attached to the natural hair of the user, so as to be subject to easy displacement or dislodgment. In other cases, the mode of attachment of the supplemental hair to the fastening device is such that the supplemental hair is readily recognizable as such. In many cases, known devices suffer from both of the aforementioned disadvantages.

In accordance with the present invention, a novel and improved hair accessory device is provided which incorporates a claw-type hair clip device, in itself well known, and incorporates supplemental hair strands with such device in a novel and unique manner such that it is extremely difficult to ascertain that the supplemental hair is not the natural hair of the wearer.

Pursuant to the invention, the new hair accessory comprises a claw-type hair clip, which comprises a pair of arcuately contoured comb-like clip elements secured together for pivotal movement. In a closed position of the clip, the tines of one element are received in between-tine spaces of the other element. A spring urges the claw elements to their closed position, but the claw can be easily opened manually by squeezing together tabs provided for this purpose on the respective claw elements.

A quantity of supplemental hair, which advantageously may be arranged in the form of a flat ribbon of side-by-side hair strands, is secured on the inside of the clip, preferably extending over a substantial portion of the length of the clip. Upper ends of the supplemental hair strands are secured to an inside surface area of at least one of the clip elements, at a level above the between-tine spaces of the clip element. The hair strands are divided into groups and the individual groups are led through the spaces of one of the clip elements. When the clip is installed in the wearer's hair, the multiple strand groups of supplemental hair, exiting from the between-tine spaces of the clip give every appearance of being the natural hair of the wearer, because the securement of the supplemental hair is completely concealed from the outside observer.

In various embodiments of the invention, the supplemental hair may be allowed to drape naturally in separated strands from the clip, or may be gathered externally of the clip to form one or more braids.

Pursuant to another embodiment of the invention, the strands of supplemental hair, especially if braided, may have multiple beads and other eye-catching fashion elements attached thereto to achieve startling and highly desirable fashion effects. The use of such fashion elements is made more practical by the present invention, as a result of the use of the claw-type clip, which attaches tenaciously to the wearer's hair, such that the added weight and momentum of the fashion elements does not tend to detach the clip from the position in which it is installed by the user.

For a more complete understanding of the above and other features and advantages of the invention, reference should be made to the following detailed description of preferred embodiments of the invention and to the accompanying drawings.

DESCRIPTION OF PREFERRED EMBODIMENTS

Figure 1:
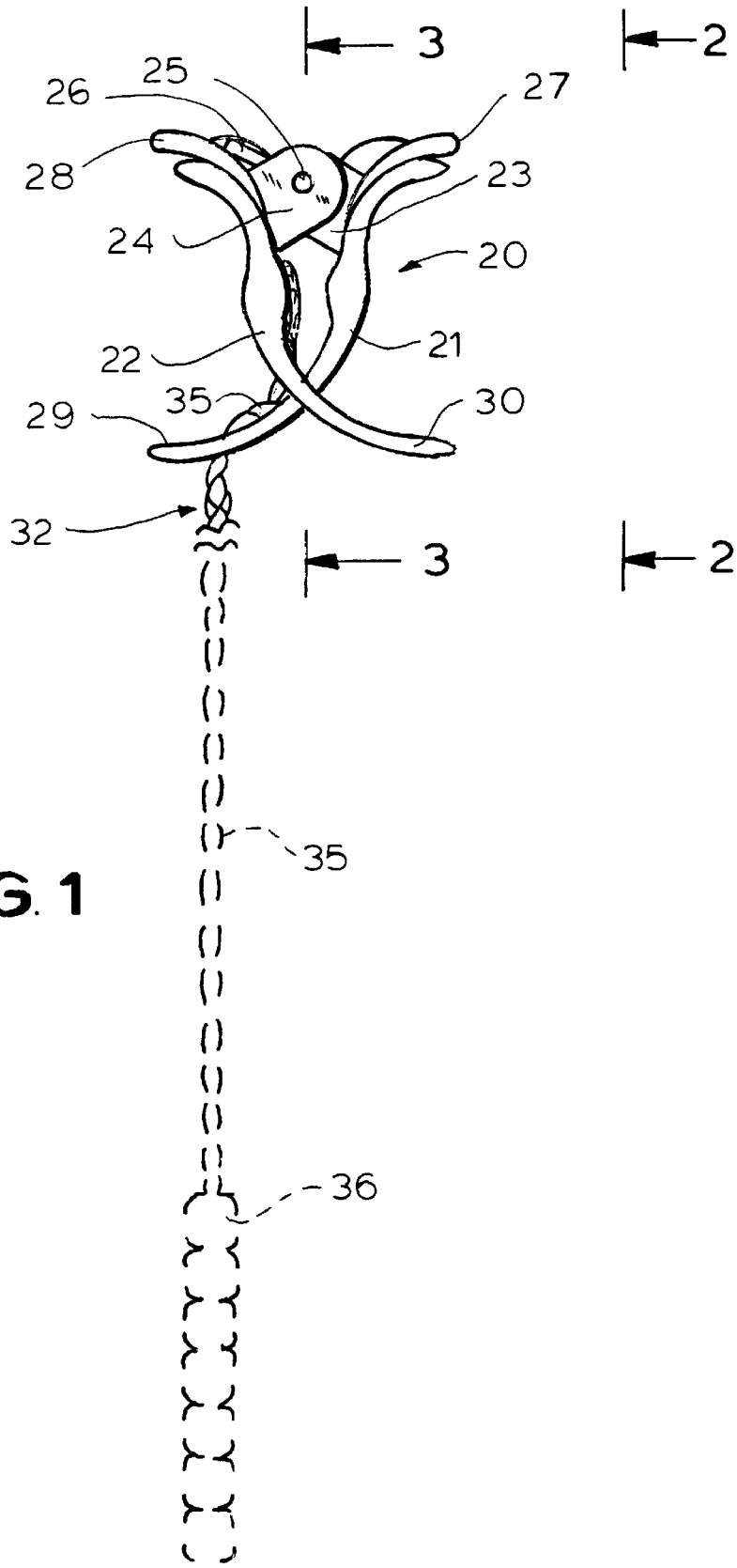
FIG. 1 is an end elevational view of one preferred embodiment of the hair accessory of the invention.

Referring now to the drawings, and initially to FIGS. 1–5 thereof, the reference numeral 20 designates generally a claw-type hair clip which per se is known in the art. The clip comprises a pair of comb-like clip elements 21, 22 typically of molded plastic material. Each clip element is provided with a pair of hinge elements 23, 24 engaged by a pin 25, connecting the two clip elements 21, 22 for pivoting movement about the axis of the pin. A spring 26 is provided to urge the clip elements to a "closed" position, as shown in FIG. 1. The clip elements are provided with manually engageable tabs 27, 28 in the upper portion thereof. These tabs may be engaged by the thumb and index finger of a user, and squeezed to pivot the clip elements to an "open" position (not shown).

Figure 2:
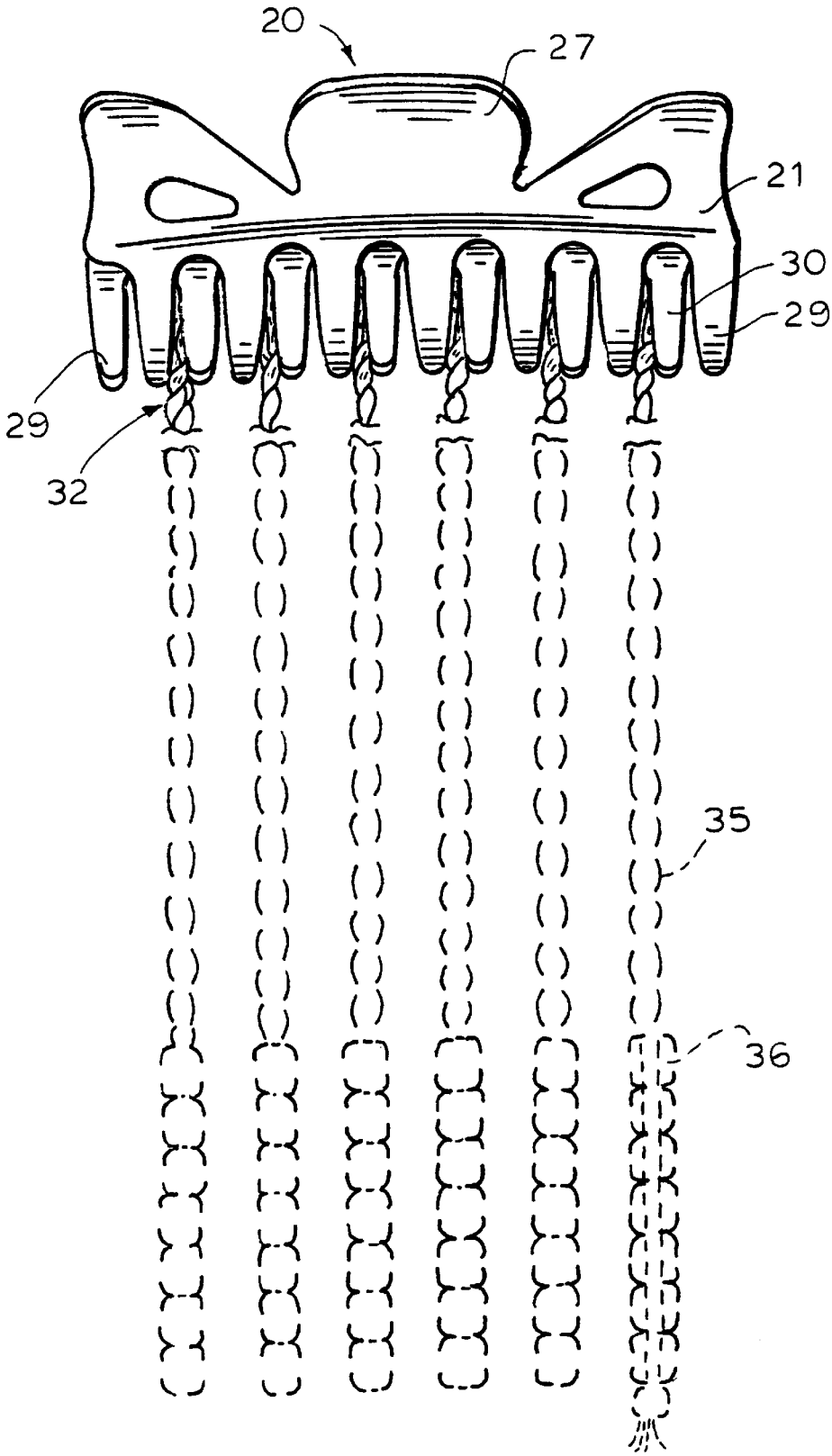
FIG. 2 is a side elevational view of the hair accessory of FIG. 1, as viewed generally along line 2—2 of FIG. 1.

As reflected in FIGS. 1–3, the lower portions of the clip elements 21, 22, below the pivot axis thereof, are of oppositely curved arcuate configuration. Additionally, each of the clip elements has a comb-like structure in its lower portion, comprised of arcuate tines 29, 30 separated by spaces 31. When the clip parts are in a closed position, as reflected in FIG. 1, the tines 29 of one clip part are deeply received into spaces 31 defined by the tines of the opposite clip part. Typically, the spring 26 urges the clip elements 21, 22 to a closed position in which the tines of one element move substantially to the closed ends of the spaces between tines of the other element. When the clip is opened, by pressing the tabs 27, 28 together, the respective tines 29, 30 are completely separated and spaced a substantial distance apart, such that the clip may be easily inserted into a mass of hair, and then released to return to a closed configuration, firmly attached to the hair.

In the form of the invention shown in FIGS. 1–5, a ribbon-like strip of pre-cut supplemental hair 32 is secured to an inside surface of the clip element 22, immediately above the spaces 31 formed in the lower portion thereof. To particular advantage, the supplemental hair 32 is in the form known as track hair, available from commercial suppliers of such products. Track hair is produced by placing multiple strands of hair, natural or synthetic as desired, in side-by-side arrangement of the strands. The side-by-side strands are then stitched together by a sewing machine, forming an edge structure somewhat similar to the selvage edge found on woven fabrics. The track hair thus formed may have an overall width (i.e. in the direction of the track or "selvage" formed by the sewing machine), of as much as twenty-four inches or so. After sewing, any uneven ends beyond the track or selvage may be trimmed off.

Pursuant to the invention, a "ribbon" of track hair is formed by cutting a section of the track hair to provide a narrower ribbon 32 of the hair, having an overall width, measured in the direction of the track or selvage 33, which is slightly less than the overall length of the clip 20. The track or selvage 33, as shown in FIG. 3, is secured along the inside surface of one of the clip elements, in this case the element 22, with the selvage or track 33 extending generally parallel to the pivot axis formed by the pin 25. To advantage, the selvage margin is secured to the clip element 22 by a suitable adhesive. The selvage is fixed in a position at or slightly above the closed ends of the between-tine spaces 31, so as to be effectively invisible externally of the clip 20. To a third party observer, only natural-appearing hair emanates from within the clip.

Figure 3:
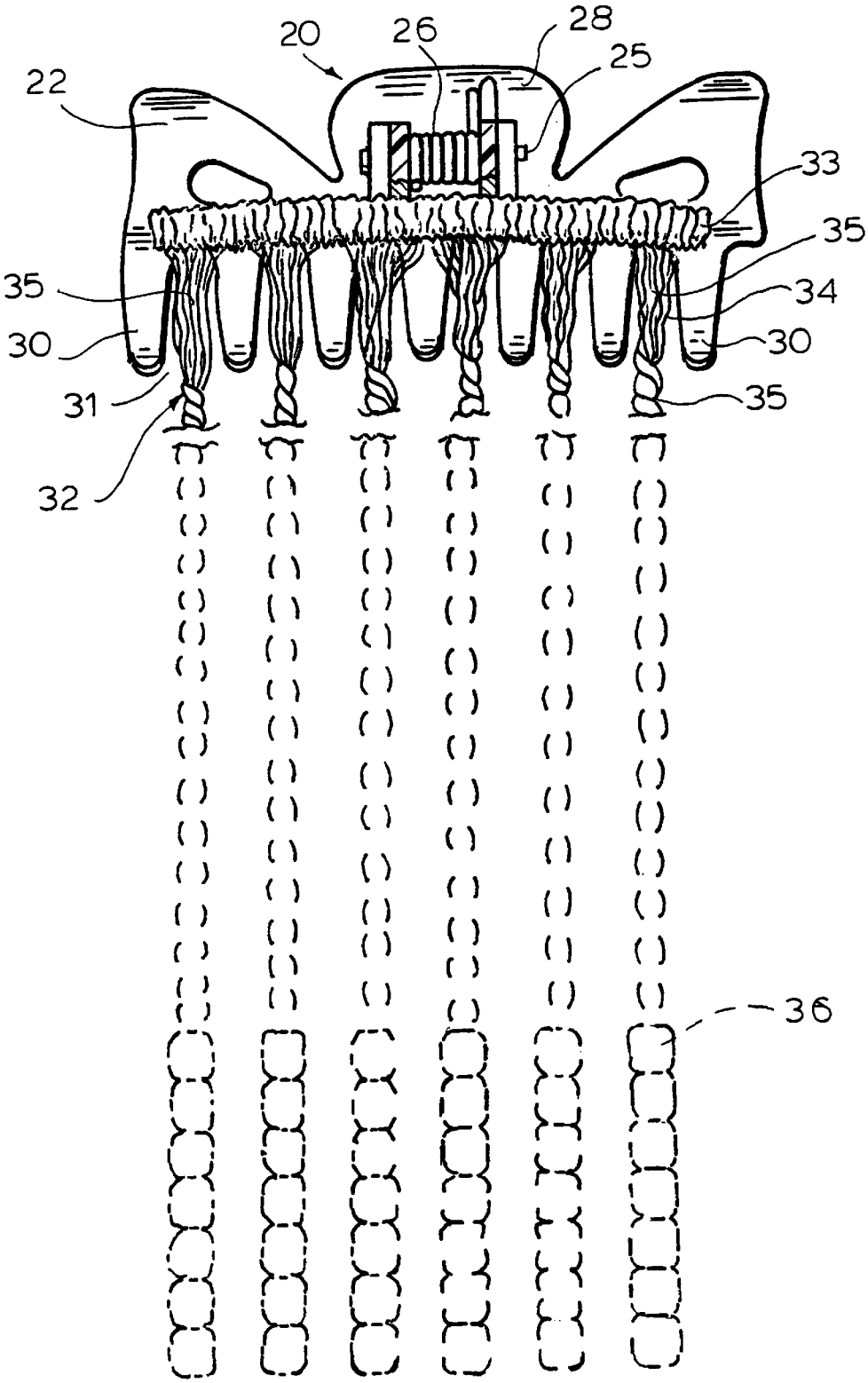
FIG. 3 is a cross sectional view as taken generally on line 3—3 of FIG. 1.
Figure 4:
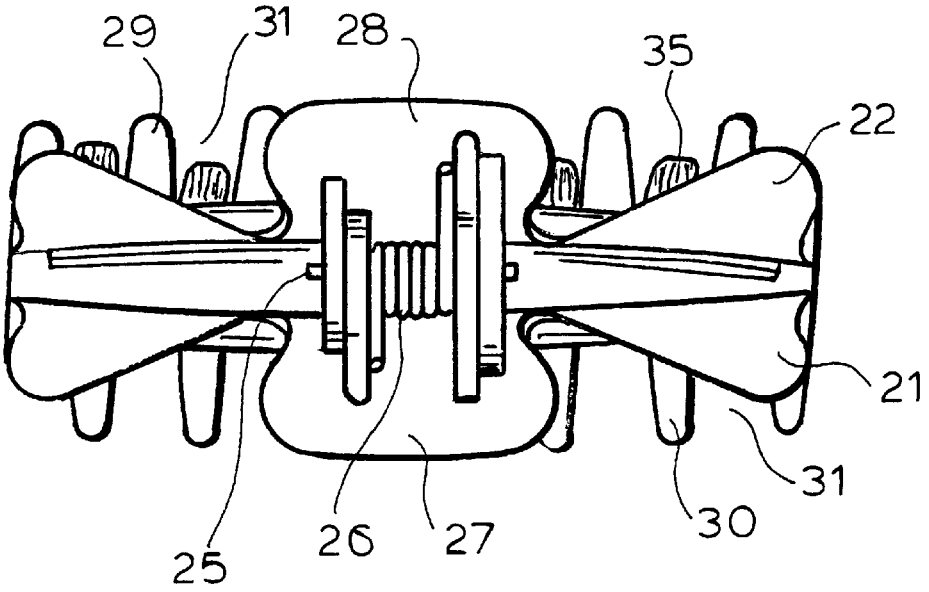
FIGS. 4 and 5 are top and bottom views respectively of the hair accessory of FIG. 1.
Figure 5:
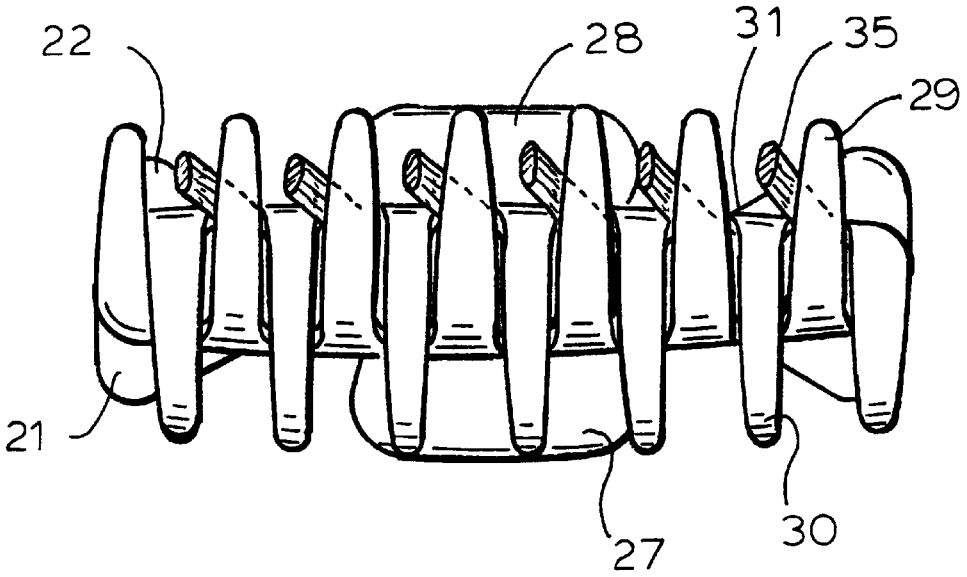

As reflected in FIG. 3, the individual strands 34 of the supplemental hair are distributed more or less uniformly across the full width of the selvage 33. Pursuant to the invention, however, the strands 34 are separated into adjacent groups 35 of gathered strands, which are led outward through the individual spaces 31 between the tines 30. When the clip is in a closed condition, as indicated in FIG. 1, the individual strand groups 35 pass through defined openings the extreme upper ends of the spaces 31, being confined therein by tines 29 of the opposite clip part.

In the form of the invention illustrated in FIGS. 1–5, the individual strand groups 35 are formed into individual braids, which hang naturally from the clip 20. In many cases, it is desirable to decorate the braids with fashion items, such as beads or the like, illustrated at 36 in FIGS. 1–3. An array of colorful beads provides an extremely attractive and eye-catching fashion element in the hair arrangement of the wearer. The arrangement of the invention is particularly advantageous where such beads or the like are incorporated with the strand groups 35. Because of the weight of the beads, and the momentum that may be involved with sudden head movements of the wearer, it is important that the hair accessory be firmly and reliably secured in place. The claw-type clip is ideal for this purpose.

Although the user is free to apply the accessory in any manner she chooses, it is quite typical for an accessory of the type shown in FIGS. 1–5 to be applied along the side of the head, so that the individual strand groups 35 dangle freely along one side.

Figure 6:
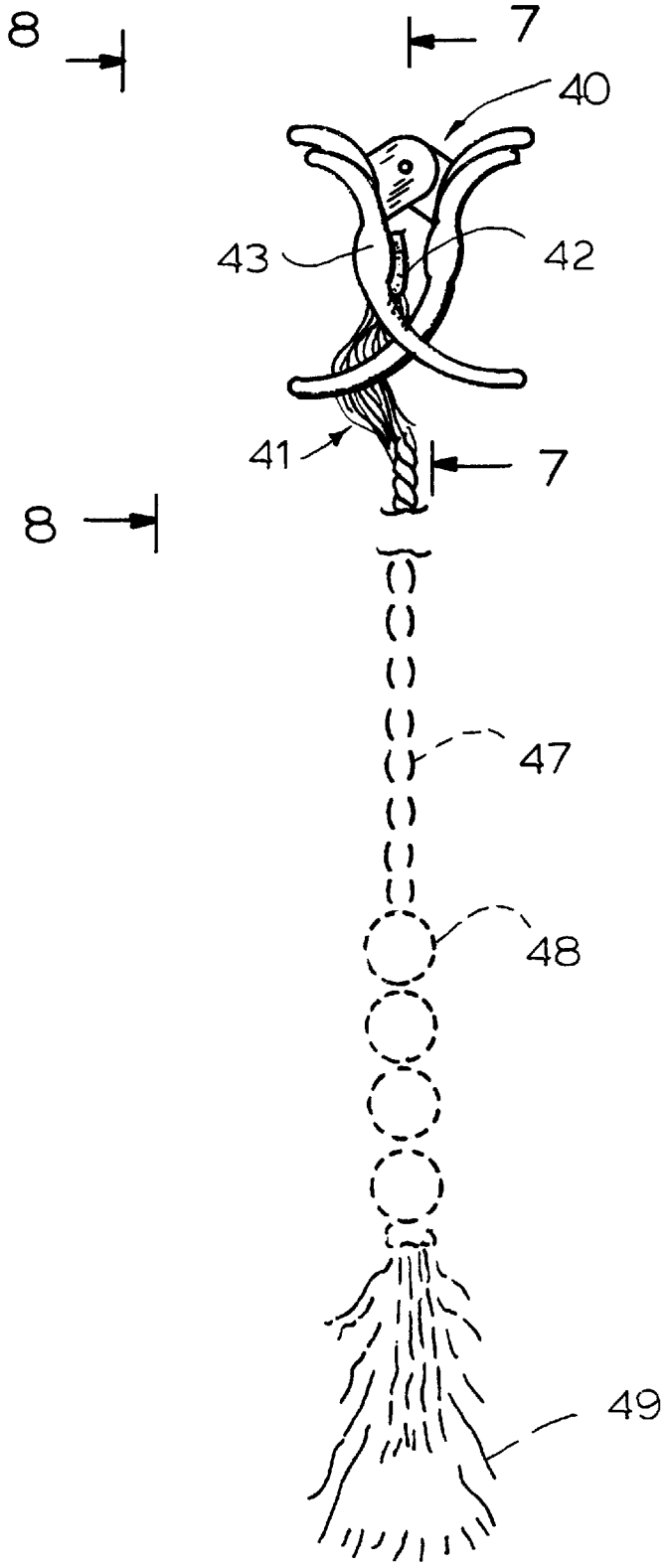
FIG. 6 is an end elevational view of a second preferred embodiment of the invention.
Figure 7:
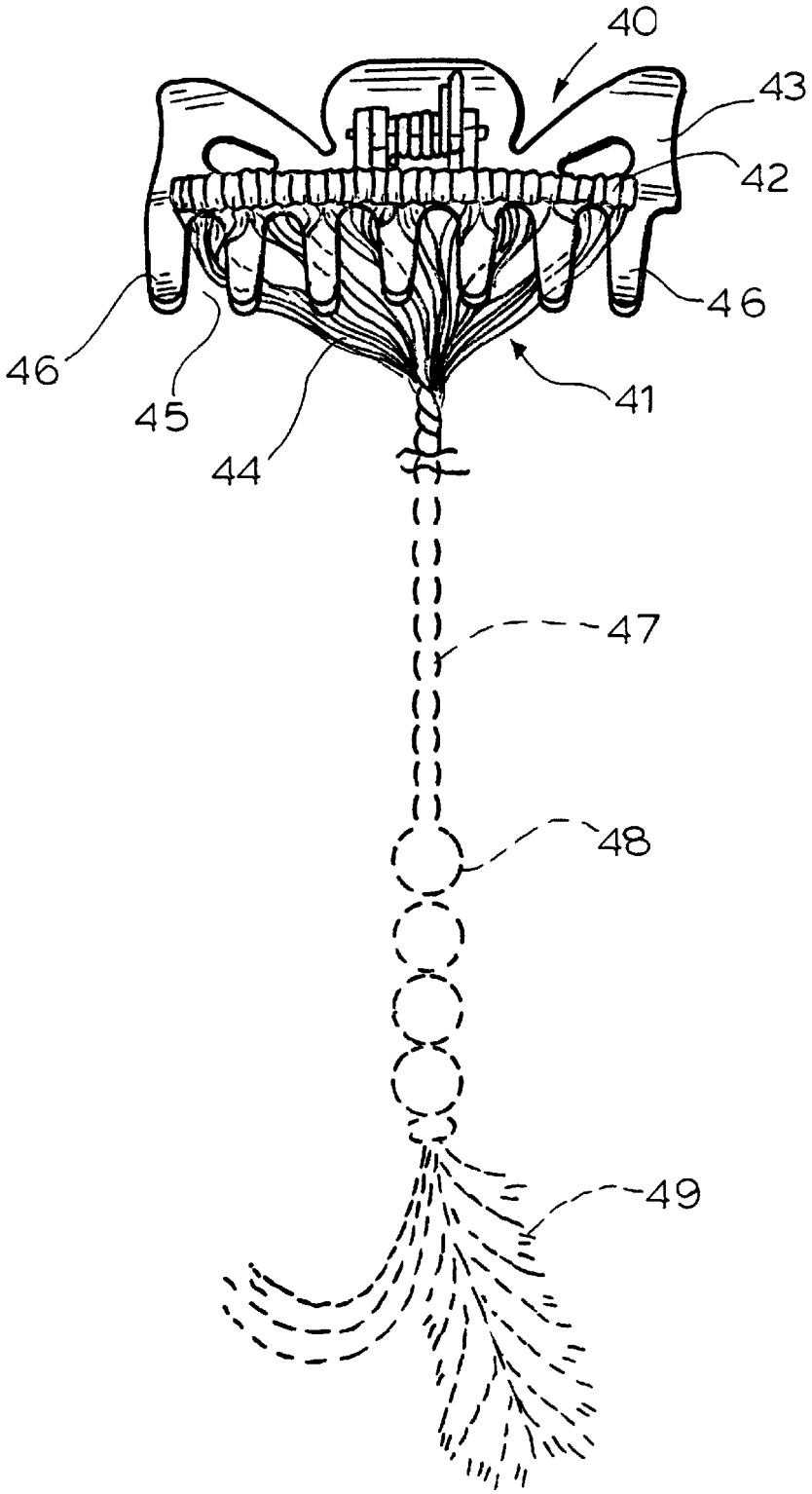
FIG. 7 is a cross sectional view as taken generally on line 7—7 of FIG. 6.
Figure 8:
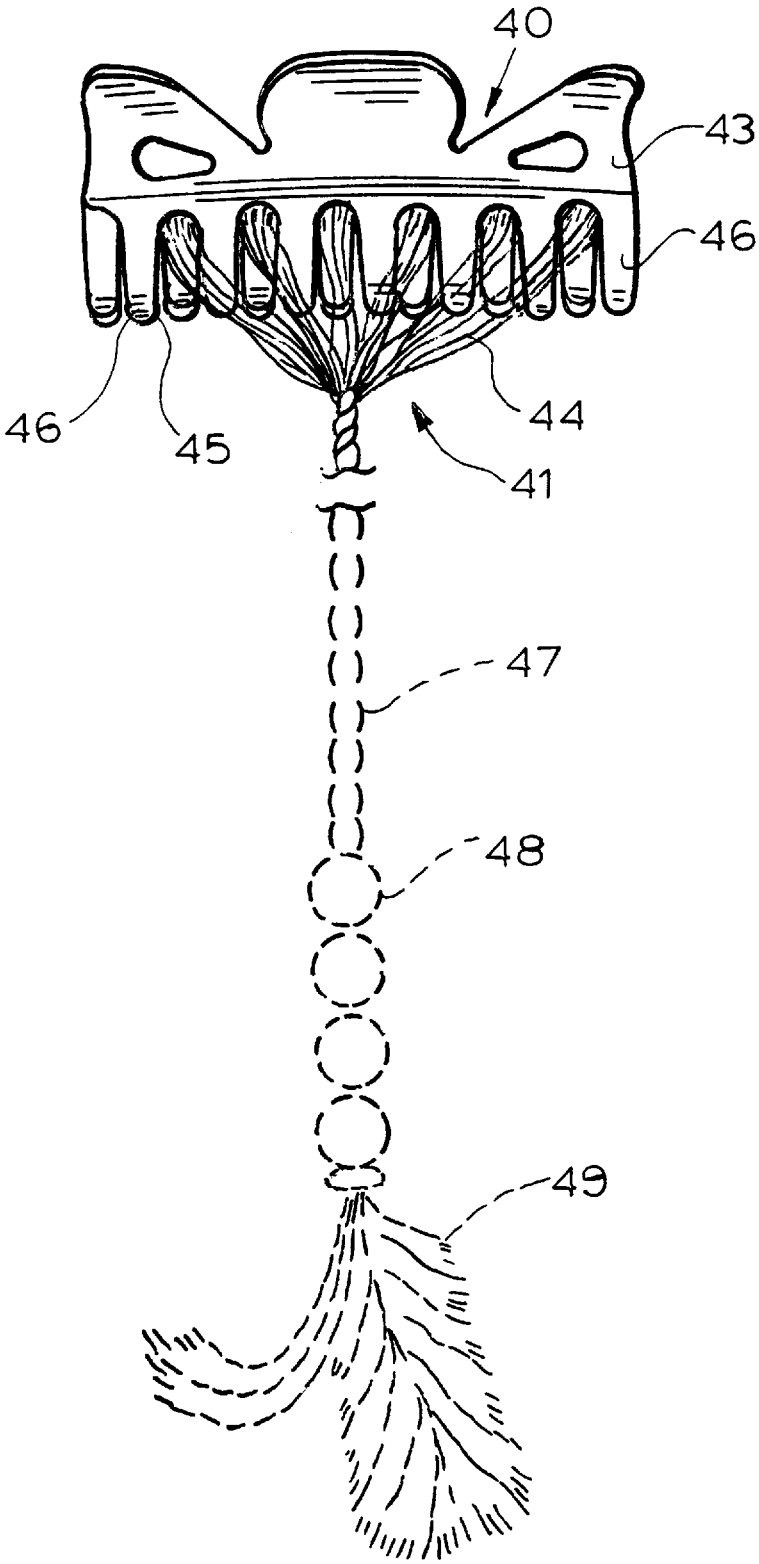
FIG. 8 is a side elevational view of the device of FIG. 6, as viewed generally one line 8—8 of FIG. 6.

The embodiment of FIGS. 6–8, a claw-type clip 40 constructed generally as described with respect to FIGS. 1–5, mounts a ribbon 41 of supplemental hair. The supplemental hair is of the track of selvage type, and is secured to the clip 40 by adhesively securing a selvage portion 42 thereof to one of the clip parts 43, on an inside surface thereof, as illustrated in FIGS. 6 and 7. Typically and advantageously, the ribbon 41 of supplemental hair is cut to a width slightly less than the length of the clip, so that the selvage 42, when secured to the clip part 43, is recessed slightly at each end thereof.

As in the case of the embodiment of FIGS. 1–5, individual groups 44 of hair strands are separated along the length of the selvage 42 and are passed outwardly through the spaces 45 between tines 46 of the clip part 43. In the embodiment of FIGS. 6–8, all of the strand groups 44 are drawn together, along the outside surfaces of the tines 46 and brought together to form a single braided strand 47 which extends downward generally from the center of the clip 40.

As with the embodiment of FIGS. 1–5, the braid 47 may be electively adorned with eye-catching articles, such as beads 48 and/or feathers 49.

Although only a single common braid 47 is shown in the FIGS. 6–8 embodiment, it will be understood that the strand groups may be combined to form two or more braids.

Figure 9:
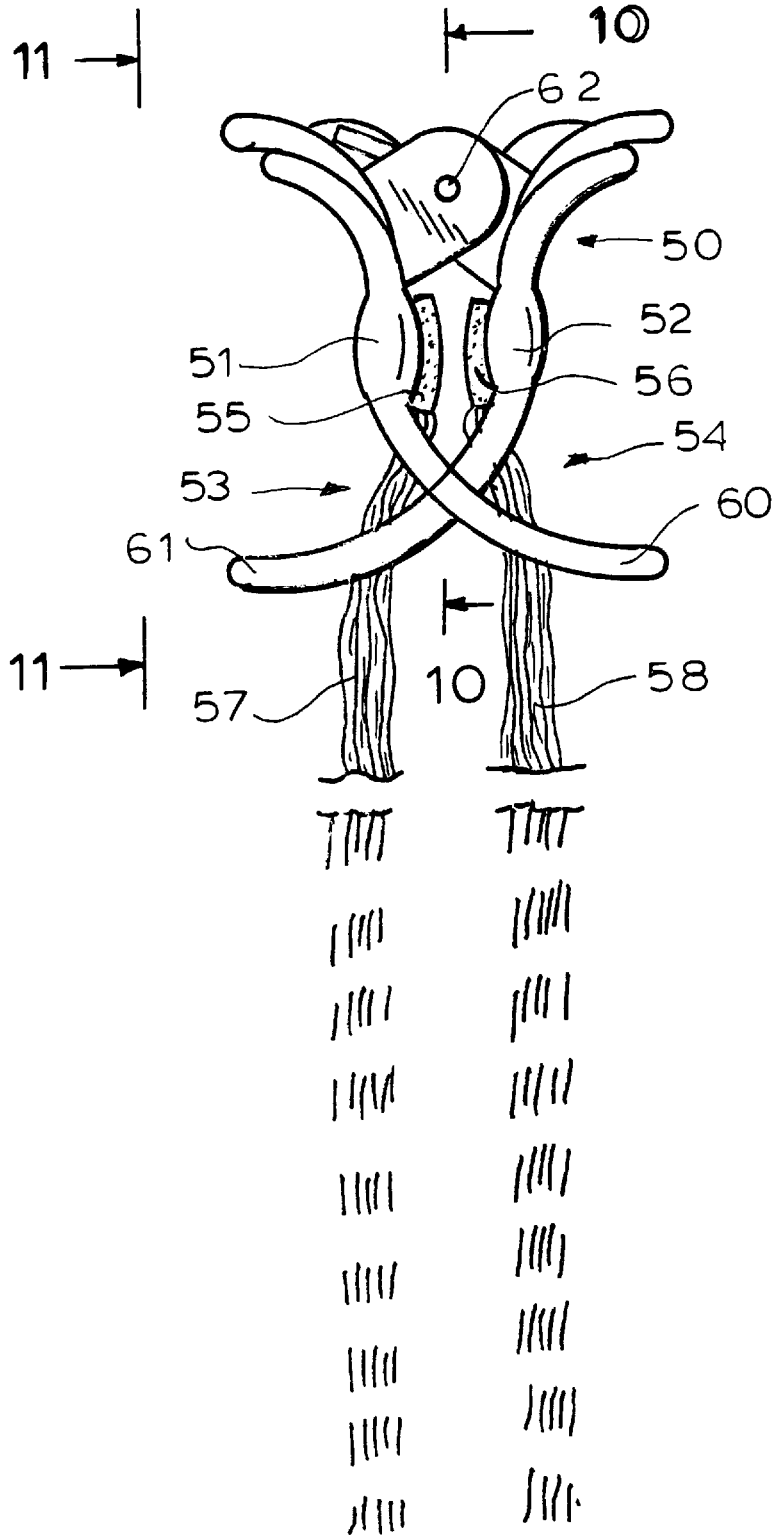
FIG. 9 is an end elevation of a further preferred embodiment of the invention, which is arranged to provide strands of supplemental hair exiting from both sides of a claw-type clip device.
Figure 10:
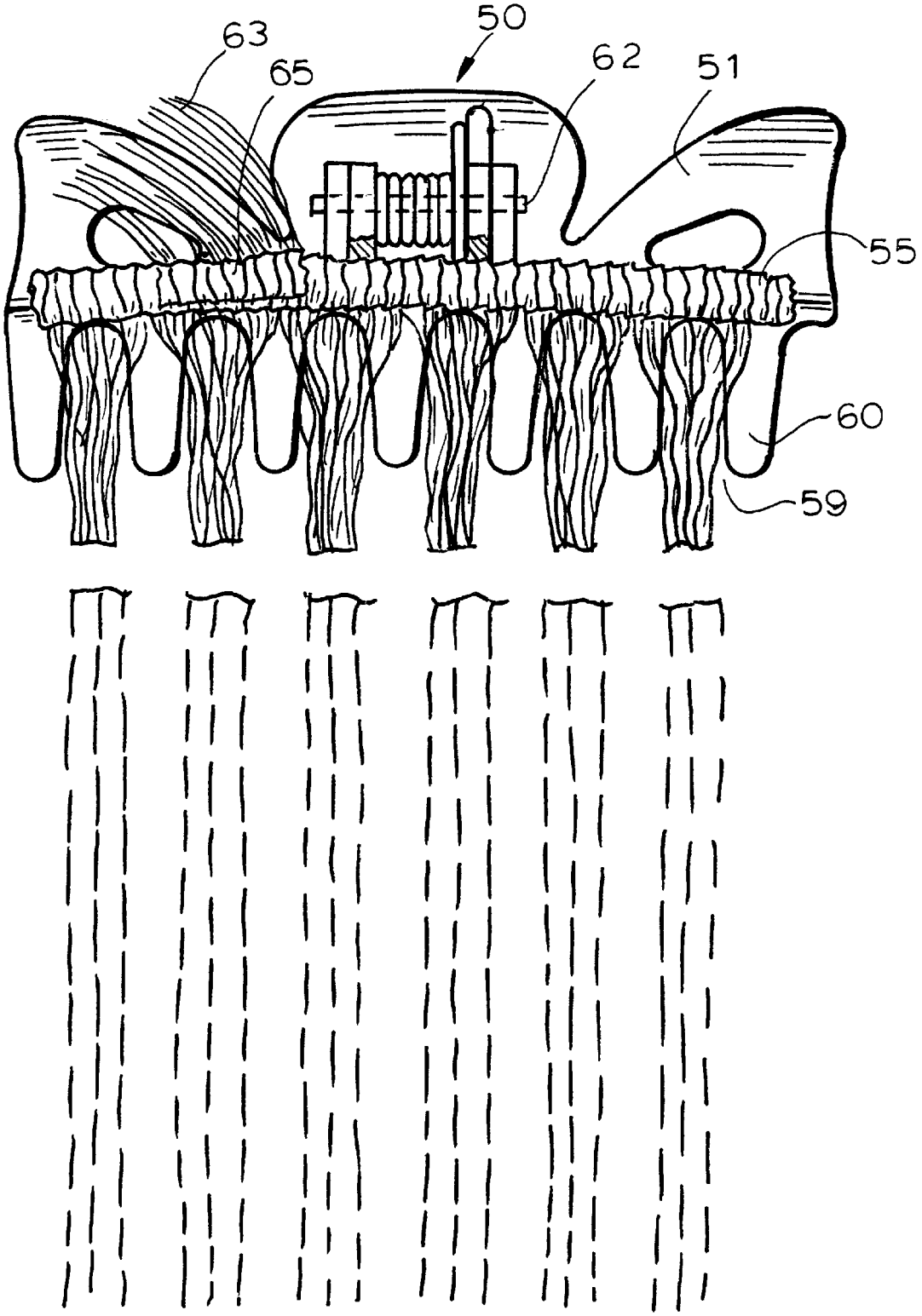
FIG. 10 is a cross sectional view as taken generally on line 10—10 of FIG. 9.
Figure 11:
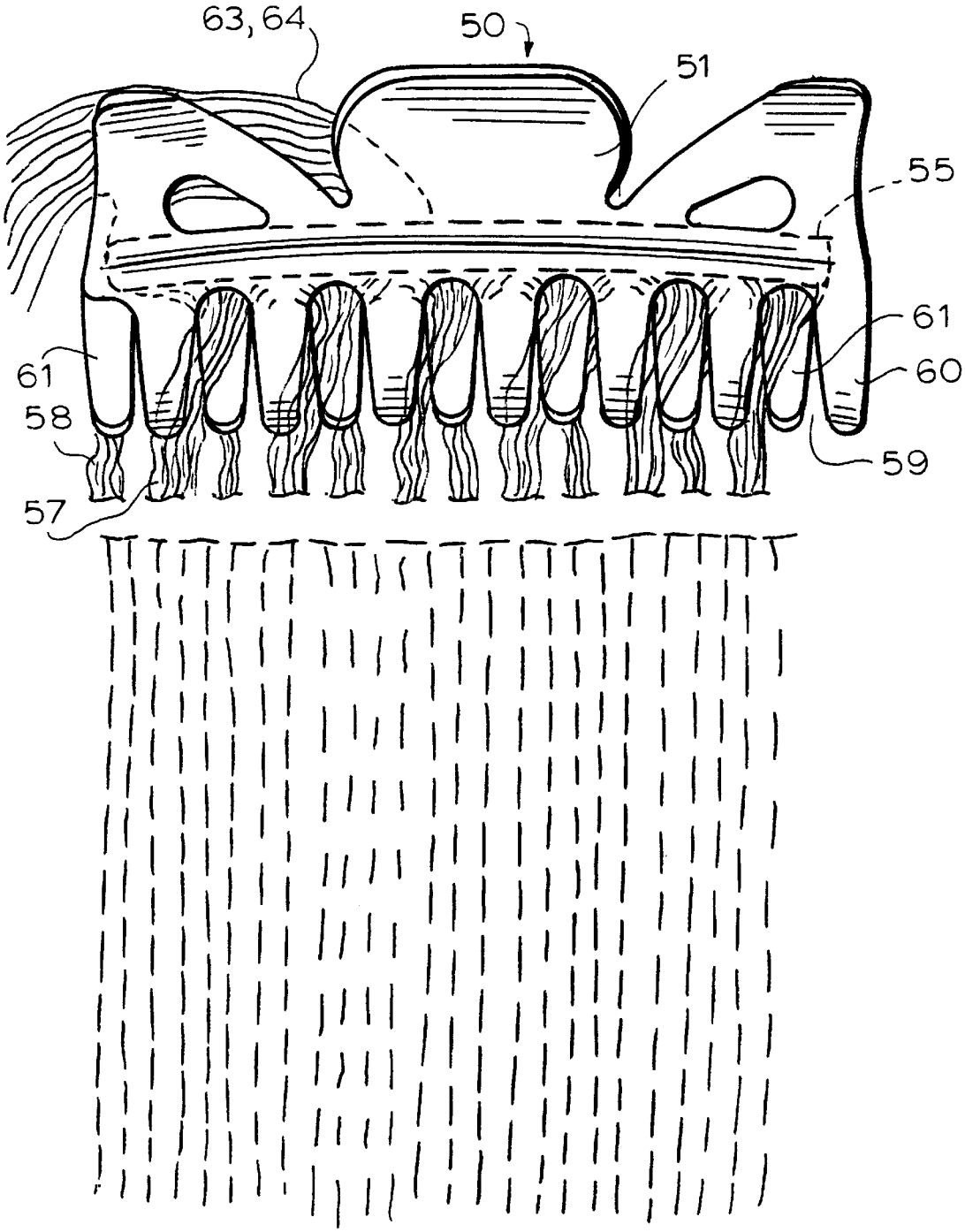
FIG. 11 is a side elevational view of the device of FIG. 9, as viewed generally along line 11—11 of FIG. 9.

In the embodiment of FIGS. 9–11, a claw-type clip 50, of a construction similar to the clips 20 and 40 previously described, and comprising clip elements 51, 52 is provided with two separate ribbons 53, 54 of supplemental track hair, one associated with each of the clip parts 51, 52. The ribbons 53, 54 are secured by their selvedges 55, 56, in the manner previously described, such that the selvedges are completely concealed on the inside of the clip 50. In the form of the invention shown in FIGS. 9–11, the ribbons 53, 54 of supplemental hair are divided into individual strand groups 57, 58 and these groups are led through spaces 59 between tines 60, 61 of the respective clip parts. As shown in FIG. 9, the strand groups 57 of the ribbon 33 are led through spaces in the 20 clip part 51, while the strand groups 58 are led through spaces in the clip part 52. Unlike the previously described embodiments, however, the strand groups 57, 58 of the FIGS. 9–11 embodiment are not braided or otherwise confined, but are allowed to drape freely, as individual hair strands.

The embodiment of FIGS. 9–11 typically may utilize a clip of substantially larger size than the clips described in FIGS. 1–8. The clip of FIGS. 9–11 most advantageously is installed at the back of the head, with its axis (as defined by the hinge pin 62) extending generally vertically. In this configuration, the strand groups 57, 58 flow outward to each side from the multiple between-tine spaces 59 in the clip parts and drape downward, somewhat in the manner of a ponytail, giving every appearance of being the natural hair of the user.

The embodiment of FIGS. 9–11 may advantageously further include one or more additional ribbons 63, 64 of track hair, with the ribbon 63 being secured by its selvage 65 to the clip part 52, as shown in FIG. 10. The selvage 65 may be adhesively secured over (or under) the primary selvage 55. A similar ribbon 64 of supplemental hair may be secured to the opposite clip part 52. The additional ribbons 63, 64 are arranged to exit out of the back of the clip, as shown in FIGS. 10, 11, enhancing the ponytail effect of the accessory, when the clip is installed in a generally vertical orientation at the back of the user's head.

As will be readily appreciated, the accessory device of the invention can be designed to provide a wide variety of fashion effects, all within the basic principles of the invention. For example, instead of a single ribbon of supplemental hair of generally homogeneous color, the device may employ a plurality of narrower ribbons, with hair of different colors, or ribbons may be stacked one upon the other, somewhat in the manner of the device of FIG. 10 to provide different effects. The fundamental elements of the invention, in all cases, include the use of a claw-type clip, in which supplemental hair, in flat ribbon form, is secured to the inside of at least one of the clip parts, with the ribbon of supplemental hair being divided into a plurality of strand groups which are led outward through between-tine spaces of one of the clips. Because of the way in which the strand groups exit through the individual spaces, the effect to the third party observer is that the hair strands emanating from the clip are the natural hair strands of the wearer. With clip-on accessory arrangements heretofore known, it is typically very obvious that the accessory device is nothing more than a clip-on accessory.

The device of the invention also lends itself well to the use of beads and other eye-catching accessories suspended from braided strands of the supplemental hair. Because the claw-type clip provides such a secure and natural-looking attachment to the wearer's hair, relatively heavy embellishments, such as beads and the like may be attached without the wearer having to be concerned that the extra weight and momentum will dislodge the clip from its installed position.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A hair accessory, which comprises (a) a claw-type hair clip comprised of (i) first and second oppositely arcuately contoured claw elements pivotally joined along an axis extending longitudinally of said clip, (ii) said claw elements having body portions adjacent said axis and elongated, narrow, arcuate comb-like tines extending from said body portions, with intervening, elongated, narrow arcuate spaces between said tines, (iii) the tines of one claw element being received within spaces between tines of the other claw element and defining openings between said tines and closed ends of the spaces in which said tines are received when said claw elements are in a closed position, (iv) manually engageable elements on said claw elements for pivoting said claw elements to an open position and spring means tending to pivot said claw elements to a closed position, (b) a ribbon of cut hair comprised of a plurality of strands of hair arranged generally in side-by-side fashion and forming a generally flat ribbon like arrangement of substantial length and of a width corresponding to the distance between a plurality of tines of said claw elements, (c) one end margin of said ribbon being secured to an inside surface of the body portion of one of said claw elements in an orientation generally parallel to said axis, (d) a plurality of groups of said individual strands of hair being lead outwardly of said clip through a plurality of adjacent ones of said defined openings formed by said elongated arcuate spaces of at least one of said claw elements in a manner providing an appearance of the user's own hair being engaged by said clip, when said clip is installed in the user's existing hair mass.

2. A hair accessory according to claim 1, wherein (a) the strands of hair forming said ribbon are joined laterally at said one at one end margin of said ribbon to form a selvage, and (b) said selvage is adhesively bonded to said inside surface.

3. A hair accessory according to claim 1, wherein (a) a second ribbon of hair, similar to the first-mentioned ribbon, is bonded to an inside surface of the body portion of the other of said claw elements, and (b) a plurality of groups of individual strands of hair of the second ribbon are lead outwardly of said clip through a plurality of adjacent ones of said defined openings formed by elongated, arcuate spaces of at least one of said claw elements.

4. A hair accessory according to claim 1, wherein (a) said groups of individual strands are combined externally of said clip and formed into one or more braided strands depending from said clip.

5. A hair accessory according to claim 1, wherein (a) the individual strands of each group are combined in a braid, and (b) a plurality of such braids depend from a plurality of said defined openings.

6. A hair accessory according to claim 1, wherein (a) the cut hair of said ribbon is natural or synthetic.

7. A hair accessory according to claim 1, wherein (a) said groups of individual strands are formed into one or more braids externally of said clip, and (b) decorative beads are attached to said braids.

8. A hair accessory according to claim 1, wherein (a) one or more additional ribbons of cut hair are secured to an inside surface of at least one of said claw elements and are lead outward of said clip from the side of said axis opposite to said tines.

9. A hair accessory according to claim 3, wherein (a) the plurality of groups of individual strands of hair of each of said ribbons are led outwardly through adjacent ones of said defined openings of the same claw element to which such ribbon is secured.

* * * * *